US007184867B2

(12) United States Patent
Okuyama

(10) Patent No.: US 7,184,867 B2
(45) Date of Patent: Feb. 27, 2007

(54) WATERCRAFT NETWORK

(75) Inventor: Takashi Okuyama, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/508,363

(22) Filed: Aug. 22, 2006

(65) Prior Publication Data

US 2006/0293807 A1 Dec. 28, 2006

Related U.S. Application Data

(62) Division of application No. 10/293,718, filed on Nov. 12, 2002, now Pat. No. 7,096,097.

(30) Foreign Application Priority Data

Nov. 12, 2001 (JP) ..... 2001-346075

(51) Int. Cl.
*B60L 3/00* (2006.01)

(52) U.S. Cl. ..... 701/36; 701/21; 340/438; 340/425.5

(58) Field of Classification Search ..... 701/21, 701/36, 99, 37, 213, 206, 101–115; 440/84; 114/144 R, 146; 74/480 B; 340/933, 425.5, 340/426.18, 426.24, 438
See application file for complete search history.

(56) References Cited

U.S. PATENT DOCUMENTS 6,213,820 B1 * 4/2001 Kanno ..... 440/1
6,273,771 B1 * 8/2001 Buckley et al. ..... 440/84
6,286,492 B1 * 9/2001 Kanno ..... 123/684
6,325,046 B1 * 12/2001 Kanno ..... 123/406.44
6,357,423 B1 * 3/2002 Kanno ..... 123/497

* cited by examiner

*Primary Examiner*—Richard M. Camby
(74) *Attorney, Agent, or Firm*—Knobbe, Martens, Olson & Bear, LLP

(57) ABSTRACT

A network for a vehicle correlates network addresses with functions. The network can be used to connect control devices and an outboard motor mounted to a watercraft. Each physical node on the network can include one or plurality of functional nodes. The network can be configured to assign network addresses to devices on the network based on the functions performed by the devices, respectively.

4 Claims, 9 Drawing Sheets

88 89 90 91

| Physical node | Function node | | |
|---|---|---|---|
| Physical node name | Function node name | Node number | Communication item |
| Key switch | Managing node | 001 | Operation start command |
| | | | Stop SW ON/OFF |
| | | | Start SW ON/OFF |
| Shift throttle | Throttle target | 002 | Throttle target opening |
| | Shift target | 003 | Shift target position |
| Steering | Steering target | 004 | Steering target position |
| Fuel measuring | Fuel level | 005 | Remaining fuel |
| | Fuel flow | 006 | Fuel flow |
| GPS | GPS | 007 | Current position |
| ECU | Engine speed | 008 | Engine speed |
| | Shift position | 009 | Shift position |
| | Throttle opening | 010 | Throttle opening |
| | Steering angle | 011 | Steering angle |
| Inboard display | Inboard display | 012 | |

*Figure 3*

WATERCRAFT NETWORK

PRIORITY INFORMATION

This application is a divisional of U.S. application Ser. No. 10/293,718, filed Nov. 12, 2002 now U.S. Pat. No. 7,096,097 which is based on and claims priority to Japanese Patent Application No. 2001-346075, filed Nov. 12, 2001, the entire content of which is hereby expressly incorporated by reference.

BACKGROUND OF THE INVENTION

1. Field of the Invention

The present invention generally relates to a vehicle, and more particularly, to a network for a vehicle.

2. Description of the Related Art

Relatively small watercraft such as pleasure boats and fishing boats can employ a propulsion unit such as an outboard motor. Many of such watercraft include a cockpit disposed remotely from the outboard motor. Usually, the cockpit includes a plurality of remote control devices for controlling the operation of the outboard motor, such as the throttle position, gear position, and steering angle.

Such outboard motors typically incorporate an internal combustion engine and a propeller disposed in a submerged position when the associated watercraft rests on a surface of a body of water. The engine powers the propeller to propel the watercraft. Such engines can include a plurality of sensors and/or actuators that are connected to the remote control devices to control and/or monitor operation of the outboard motor.

SUMMARY OF THE INVENTION

One aspect of the present invention includes the realization that the assembly of a watercraft can be simplified by assigning predetermined network addresses to predetermined functions of certain devices commonly employed in the control and/or monitoring of watercraft propulsion devices such as outboard motors. For example, all watercraft having outboard motors, except for the smallest class of such watercraft, include a cockpit disposed remotely from the outboard motor. These cockpits include at least one throttle lever, and preferably, at least one gauge cluster for monitoring the conditions of the outboard motor. Occasionally, components of the outboard motor or the remote control devices need replacement. Where the components are connected by a network, it may be necessary to re-program the other components of the network to recognize the newly-connected device. Thus, by assigning predetermined network addresses to predetermined functions, components of the network can be replaced without re-programming the other network components.

In accordance with another aspect of the present invention, a watercraft includes an input device configured to accept an input from an operator of the watercraft. A plurality of at least one of sensors and actuators are configured to perform a plurality of functions, respectively, related to the operation of the watercraft. The watercraft also includes a network connecting the input device with the plurality of at least one of sensors and actuators, and a correlation module comprising a correlation of a plurality of addresses on the network with the plurality of functions, respectively.

In accordance with a further aspect of the present invention, a data table for a network correlates network addresses and functions of devices attached to the network.

In accordance with an additional aspect of the present invention, A method for operating a network on a vehicle includes transmitting an identification command to all devices connected to the network. Replies are transmitted from the devices in response to the identification command, the replies indicate the functions performed by the devices, respectively. The method also includes correlating the functions with network addresses.

BRIEF DESCRIPTION OF THE DRAWINGS

These and other features, aspects, and advantages of the present invention will now be described with reference to the drawings of a preferred embodiment, which is intended to illustrate and not to limit the invention. The drawings comprise nine figures.

FIG. 3 is a schematic diagram illustrating a correlation module for the network addresses of the corresponding devices and their functions in FIG. 2.

DETAILED DESCRIPTION OF THE PREFERRED EMBODIMENT

Figure 1:
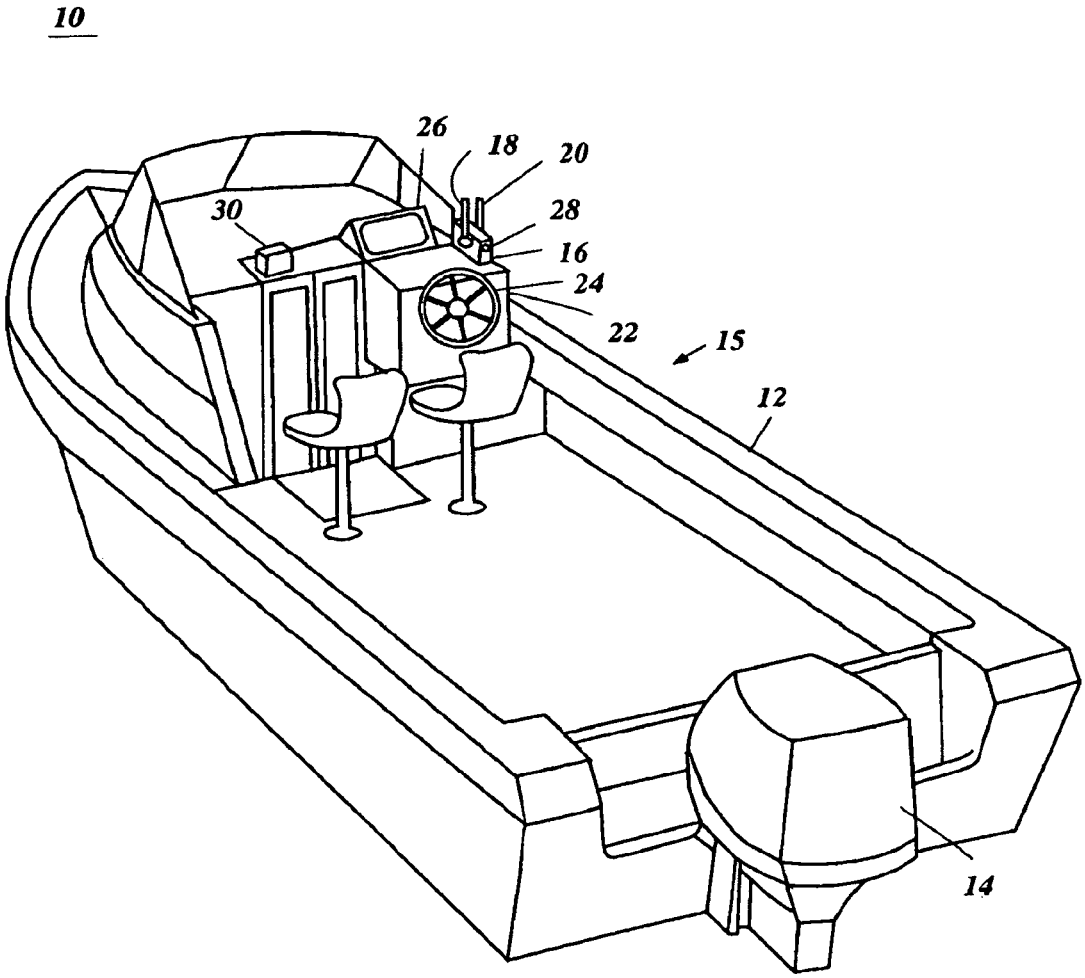
FIG. 1 is a perspective view of a watercraft having an outboard motor attached thereto, and a cockpit having a remote control and a display device for monitoring the condition of the devices on a network.

With initial reference to FIG. 1, a watercraft 10 advantageously includes a network connecting at least one outboard motor with at least one other component in the watercraft 10 and configured in accordance with certain features, aspects, and advantages of the present invention. The watercraft 10 provides an exemplary environment in which the network has particular utility. The network of the present invention may also find utility in applications where multiple engines are used in parallel.

As shown in FIG. 1, the watercraft 10 is comprised of a hull 12 and an outboard motor 14. The hull 12 defines an operator's area 15 disposed remote from the outboard motor 14. The operator's area 15 can include various devices for controlling and/or monitoring the outboard motor 14.

Figure 2:
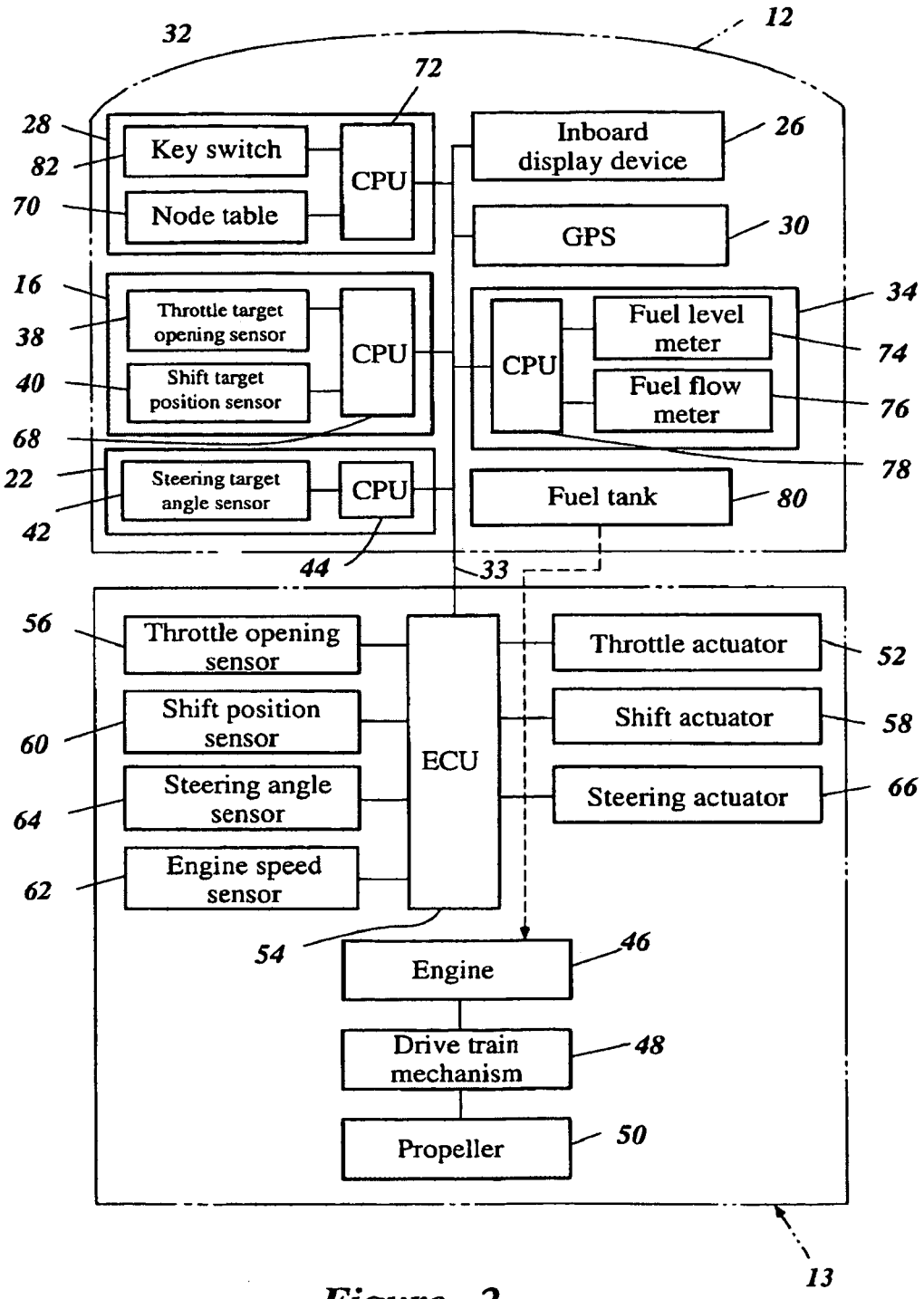
FIG. 2 is a schematic view of the watercraft in FIG. 1 and a network connecting the outboard motor with the remote control and display device.

In the illustrated embodiment, the operator's area 15 includes a remote thrust control device 16, a steering unit 22, an outboard motor condition display device 26, and a global positioning system (GPS) device 30. Additionally, as shown in FIG. 2, the watercraft 10 can include a fuel gauge device 34. Preferably, the fuel gauge device 34 is also located in the operator's area 15. A LAN 32 (FIG. 2) connects these devices.

The remote control device 16 includes at least one control lever. In the illustrated embodiment, the device 16 includes first and second levers 18, 20. The levers 18, 20 can configured to allow an operator to input a variety of input control commands for the operation of the watercraft 10. For example, the levers 18, 20 can be configured to allow an operator to input, for example, but without limitation, thrust control commands, gear position commands, trim position commands, or other commands. In the illustrated embodiment, at least one of the levers 18, 20, is configured to accept thrust control commands. Additionally, at least one of the levers 18, 20 is configured to accept gear position commands.

The remote control device 16 also includes lever angle sensors 38 and 40 configured to detect a position of the remote control levers 18 and 20, respectively. The remote control further comprises a CPU 68. The remote thrust control device 16 also includes a main power switch unit 28. The remote control 16 is described below in greater detail.

The steering unit 22 has a steering target angle sensor 42 connected to the steering wheel 24, a CPU 44. The steering unit 22 is also described below in greater detail.

The engine condition display device 26 includes engine condition display sections for displaying at least one condition of the outboard motor 14.

FIG. 2 is a block diagram schematically showing the inboard LAN (Local Area Network) system 32 within the hull 12. The LAN 32 connects the devices 22, 26, 28, 30, with the outboard motor 14. The LAN 32 may be constructed by either wire, wireless (such as infrared, radio wave, ultrasonic waves), or other means of connecting a LAN. Thus, each of the devices connected by the LAN 32 include a device for communicating in accordance with a networking protocol. The LAN 32 is described below in greater detail.

With reference to FIGS. 1 and 2, the general construction of the outboard motor 14 is set forth below.

The outboard motor 14 comprises a drive unit and a bracket assembly (not shown). The bracket assembly comprises a swivel bracket and a clamping bracket. The swivel bracket supports the drive unit for pivotal movement about a generally vertically extending steering axis. The clamping bracket, in turn, is affixed to a transom of the watercraft 10 and supports the swivel bracket for pivotal movement about a generally horizontally extending axis. A hydraulic tilt system (not shown) can be provided between the swivel bracket and clamping bracket to tilt the drive unit up or down. If this tilt system is not provided, the operator may tilt the drive unit manually. Since the construction of the bracket assembly is well known in the art, a further description is not believed to be necessary to enable those skilled in the art to practice the invention.

As used throughout this description, the terms "forward," "front" and "fore" mean at or toward the side of the bracket assembly, and the terms "rear," "reverse" and "rearwardly" mean at or to the opposite side of the front side, unless indicated otherwise.

The drive unit includes a power head disposed at an upper portion of the drive unit, and a driveshaft housing connecting the power head to a lower unit. The outboard motor 14 also includes an engine 46 disposed in the power head. A drivetrain mechanism 48 extends through the driveshaft housing and connects the engine 46 to a propeller 50 in the lower unit.

The engine 46 preferably operates on a four stroke or two stroke combustion principle. However, the engine 46 can be configured to operate on other combustion principles (e.g., diesel, rotary, etc).

The engine 46 includes a cylinder block (not shown). The cylinder block defines one or a plurality of cylinder bores extending generally horizontally and spaced generally vertically from each other. The engine can include multiple cylinder blocks defining multiple cylinder banks. As such, the engine 46 can be an in-line, V-type, or W-type engine.

A piston (not shown) reciprocates in each cylinder bore. A cylinder head assembly is affixed to one end of each cylinder block and defines combustion chambers with the pistons and the cylinder bores. The other end of each cylinder block is closed with a crankcase member defining a crankcase chamber.

A crankshaft (not shown) extends generally vertically through the crankcase chamber. The crankshaft is connected to the pistons by connecting rods and rotates with the reciprocal movement of the pistons within the cylinder bores. The crankcase member is located at the forward most position of the power head, and the cylinder block and the cylinder head assembly extend rearwardly from the crankcase member.

The engine includes an air induction system (not shown) and an exhaust system (not shown). The air induction system is configured to supply air charges to the combustion chambers through at least one intake passage. A throttle body (not shown) supports a throttle valve (not shown) therein for pivotal movement. Where multiple throttle bodies are used, the corresponding valve shafts are linked together to form a single valve shaft assembly that passes through the throttle bodies.

In the illustrated embodiment, a throttle actuator 52 (FIG. 2) is operatively connected to the throttle valve. For example, the throttle actuator 52 can be in the form of a stepper motor connected to the throttle valve shaft. The throttle actuator 52 is connected to and controlled by the ECU 54, based on the position of at least one of the levers 18, 20, described in greater detail below. When the actuator 52 rotates the throttle shaft, the throttle valve is rotated within the throttle body, thereby changing the opening of the throttle valve.

A throttle valve opening sensor or "throttle valve position sensor" 56 is configured to detect a position of the throttle valve and generate a signal indicative of the opening of the throttle valve. A signal from the position sensor 56 is sent to the ECU 54 for use in controlling various aspects of engine operation including, for example, but without limitation, fuel supply control and/or ignition control. The signal from the throttle valve opening sensor 56 corresponds to the engine load in one aspect as well as the throttle opening.

The air induction system can also include a bypass passage or idle air supply passage (not shown) that bypasses the throttle valves. The engine 46 also preferably includes an idle air adjusting unit (not shown) which is controlled by the ECU 54.

The exhaust system is configured to discharge burnt charges or exhaust gasses outside of the outboard motor 14 from the combustion chambers.

The engine 14 also includes a fuel control system (not shown). The fuel control system can be in the form of a carbureted system, an induction fuel injection system, or a direct fuel injection system. Depending on which type of system is used, the ECU 54 can be configured to control an amount of fuel delivered.

The engine 46 can also include an ignition system (not shown) configured to ignite compressed air/fuel charges in the combustion chamber. Where the engine 46 is a non-diesel engine, at least one spark plug (not shown) is fixed on the cylinder head assembly and exposed to the combustion chamber. The spark plug ignites the air/fuel charge at a timing as determined by the ECU 54 to ignite the air/fuel charge therein.

The outboard motor 14 also includes a driveshaft housing depending from the power head which encloses a drivetrain mechanism 48 connecting the crankshaft to a propeller 50. The driveshaft housing supports a driveshaft (not shown) which is driven by the crankshaft of the engine 46. A lower unit (not shown) depends from the driveshaft housing and supports a propeller shaft driven by the driveshaft. The propeller shaft extends generally horizontally through the lower unit. A propeller 50 is affixed to an outer end of the propeller shaft and is thereby driven.

The drivetrain mechanism 48 also includes a transmission (not shown) provided between the driveshaft and the propeller shaft. The transmission connects the driveshaft and the propeller shaft, which lie generally normal to each other (i.e., at a 90° angle), with a bevel gear combination.

A shifter mechanism (not shown) is configured to shift the transmission between forward, neutral, and reverse positions. In the illustrated embodiment, the outboard motor 14 also includes a shift actuator 58 configured to cause the shift mechanism to shift between the forward, neutral, and reverse gear positions. A shift position sensor 60 is configured to detect the gear position and generate a signal indicative of the gear position. As noted above, the levers 18, 20 are connected to the ECU 54. Thus, the ECU 54 can control the shift actuator 58 based on the position of at least one of the levers 18, 20.

As noted above, the ECU 54 controls engine operations including fuel supply, and firing of the spark plugs, according to various control maps stored in the ECU 54. In order to determine appropriate control scenarios, the ECU 54 utilizes maps and/or indices stored within the ECU 54 with reference to data collected from various sensors. For example, the ECU 54 may refer to data collected from the throttle valve position sensor 56 and other sensors provided for sensing engine running conditions, ambient conditions, or conditions of the outboard motor 14 that will affect engine performance.

In the illustrated embodiment, there is provided, associated with the crankshaft, at least one engine speed sensor 62 which is configured to generate a signal indicative of the speed of the engine 46. For example, the speed sensor 62 can define a pulse generator that produces pulses which are, in turn, converted to an engine speed within the ECU 54 or another separate converter (not shown).

The outboard motor 14 also includes a steering angle sensor 50 that is configured to detect an angular position of the outboard motor 14 relative to the transom of the watercraft 10 and to generate a signal indicative thereof. The outboard motor 14 also includes a steering actuator 66 that is configured to change an angular position of the outboard motor 14 relative to the transom of the watercraft 10. For example, the steering actuator 66 can comprise a hydraulic steering actuator typically used in the outboard motor arts, or any other known steering actuator. The steering actuator 66 is connected to the ECU 54 and is thus controlled by the ECU 54 based on the position of the steering wheel 24.

The above noted sensors correspond to merely some of those conditions which may be sensed for purposes of engine control and it is, of course, practicable to provide other sensors such as an oxygen sensor, a water temperature sensor, a lubricant temperature sensor, intake air pressure sensor, intake air temperature sensor, an engine height sensor, a trim angle sensor, a knock sensor, a neutral sensor, a watercraft pitch sensor, and an atmospheric temperature sensor in accordance with various control strategies.

Additionally, the ECU 54 is configured to process the controls for the outboard motor 14. The ECU 54 preferably comprises a Central Processing Unit (CPU), storage (such as RAM and ROM), auxiliary storage devices (such as non-volatile RAM, hard disk, CD-ROM, and magneto-optical disk), and a clock. The various functions described herein can be programmed into the ECU 54 in the form of a computer program. However, one of ordinary skill in the art will recognize that the ECU 54 can be comprised of one or a plurality of hard-wired modules configured to perform the functions described herein. Alternatively, the ECU 54 can be comprised of one or a plurality of dedicated or general purpose processors and memories with programs for performing the functions disclosed herein.

With respect to the LAN 32 illustrated in FIG. 2, the most widely used networking protocols require data to be distributed in packets. Each packet can include a header with identifying data, such as, for example, but without limitation, the intended recipient or the sender. Thus, when the motor 14 transmits data across the LAN 32, the motor 14 can format the data into a packet in accordance with the networking protocol, and include the identification data in the header. Advantageously, the motor 14 is configured to send engine operation condition data over the LAN 32, wherein the condition data is identified with the functional identification of the sensor. The condition data can be any type of data, including for example, but without limitation, any of the data collected from any of the sensors listed above. In the illustrated embodiment, the ECU 54 is configured to perform the function of formatting and transmitting data for communication across the LAN 32, as well as receiving data from the other components connected to the LAN 32. A conduit generally identified by the reference 33 is illustrated as connecting the various physical components on the LAN 32.

Other components on the LAN 32 that are configured to receive data from the motor 14, can be configured to read the headers of the packets moving through the LAN 32 and accept those packet having the proper header. However, this is merely an example for illustrative purposes. The functional identification can be included anywhere in the packets transmitted from the motor 14.

With reference to FIGS. 1 and 2, the remote control 16 includes lever angle sensors 38 and 40 configured to detect the position or tilt (angle) of the remote control levers 18 and 20, respectively. The lever angle sensors 38,40 are configured to sense the position in intervals in a step-wise manner. Optionally, the sensors 38,40 can be configured to detect the position of the levers 18, 20 continuously in a proportional manner.

The remote control 16 also includes a central processing unit 68 which is configured to manage the operations of the entire remote control 16. The central processing unit 68 can include a transceiver (not shown) configured to transmit and receive data from the LAN 32 in accordance with the networking protocol in operation therein. Optionally, the transceiver can be a separate component within the remote control device 16.

The switch 28 preferably includes a correlation module 70 that is configured to store functions correlated with network address data of the devices on the LAN 32. For example, the correlation module 70 can be configured to store an address data of the throttle actuator 52, even though the actuator 52 is part of outboard motor 14 which is physically connected to the LAN 32.

The condition display section 26 can comprise a general purpose display device, or can be configured to display certain types of data graphically, with text, or a combination of text and graphics. Preferably, the display section 26 is an analog or digital display such as cathode ray tube (CRT) or liquid crystal display (LCD) unit.

Preferably the watercraft also comprises a fuel supply system 34 comprising fuel level meter 74 for measuring the amount of fuel in the fuel tank 80 and fuel flow meter 76 to measure the amount of fuel being used. The fuel supply system 34 preferably also includes a CPU 78 for monitoring the fuel flow meter 76 and the fuel level meter 74.

The CPUs 72, 68, 44, and 78 are comprised of central processing units and manage the operations of each of the devices 28, 22, 36, 34. The CPUs 72, 68, 44, and 78 can be in the form of one or a plurality of dedicated, purpose-built processors with a memory for running one or a plurality of programs, or one or a plurality of general purpose processors and memory for executing one or a plurality of computer programs.

FIG. 3 schematically illustrates one embodiment of the correlation module 70. The correlation module 70 can be comprised of a module that stores indicative of the function of each physical device attached to the network correlated with an associated network address. In another embodiment the correlation module can store the network addresses correlated with groups of functions. The grouping of functions is described below in further detail.

The correlation module 70 can be configured to allow a user to manually choose one of a plurality of predetermined correlation data, and to store the manually selected correlation data in the correlation module 70. For example, in one embodiment, the correlation module 70 includes switches such as, for example, but without limitation, Dual In-line Package (DIP) switches allowing a user choose a switch configuration indicative of the function of the device or devices on the LAN 32. Optionally, the correlation module 70 can be configured to allow a user to input the functions of the devices on the LAN 32 manually. Additionally, the correlation module can be configured to be connected to a computer keyboard or a computer for receiving data indicative of the function on the LAN 32.

The correlation module 70 can be in the form of a hard-wired electronic module, a dedicated processor and memory containing one or a plurality of programs for execution by the processor, or a general purpose processor and memory storing one or a plurality of programs for execution by the general purpose processor.

In the illustrated embodiment, the correlation module 70 includes a physical node data set 88 that includes data respectively corresponding to physical devices connected to the LAN 32. For example, the physical node data set 88 includes nodes corresponding to the key switch 28, shift throttle (remote control 16), steering (steering unit 22), fuel measuring, GPS 30, ECU 54 (of the outboard motor 14), and the inboard display device 26.

The correlation module 70 also includes a functional node data set 89 including data respectively corresponding to functions of devices within the watercraft 10 and the outboard motor 14. For example, the data set 89 includes functional nodes such as a managing node, a throttle target node, shift target node, steering target node, fuel level node, fuel flow node, GPS node, engine speed node, shift position node, throttle opening node, steering angle node, and inboard display node. Of course, the data set 89 can include nodes corresponding to other functions.

The correlation module 70 also includes a network address data set 90. The network address data set 90 includes network addresses that are correlated to functional nodes. In the illustrated embodiment, the network address data set 90 includes three digit numbers for the functional nodes in the functional node data set 89, respectively. However, the network address data set 90 can include other arrangements of numerals or other indicia representing addresses on the network.

The illustrated embodiment of the correlation module 70 also includes a communication idem data set 90. The communication idem data set 90 can be configured to further correlate the addresses of the data set 90 with one or plurality of devices on the LAN 32. For example, the throttle target node of the data set 89 is correlated with the network address 002 of the data set 90. In this embodiment, the data set 90 includes a data corresponding to the throttle target opening sensor 38 which is correlated with the network address 002. However, as noted above, the data in the data set 91 can include data indicative of a plurality of devices correlated to one network address in the data set 90. For example, the managing node of the data set 89 is correlated with the network address 001. However, the communication idem data set 91 correlates three devices with the address 001, a start command operation device, a stop switch, and a start switch.

Figure 4:
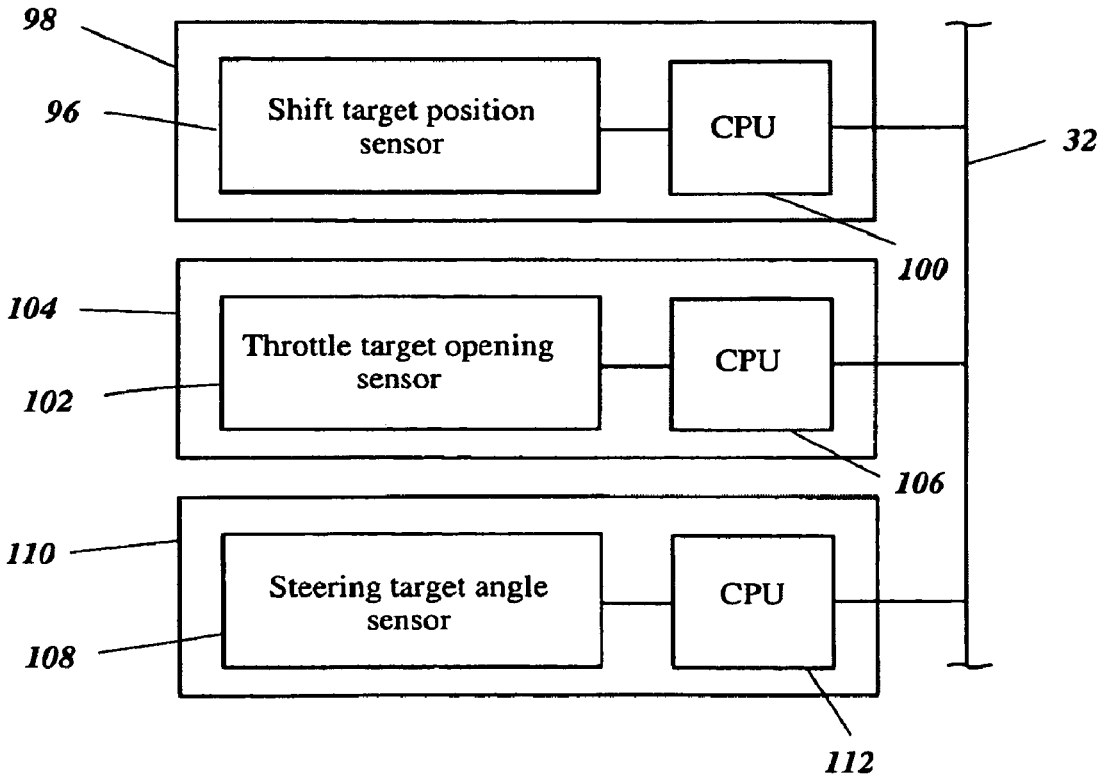
FIG. 4 is a schematic diagram illustrating a remote control device arrangement which performs a plurality of functions identified in the correlation module of FIG. 3.

FIG. 4 illustrates an exemplary embodiment of a physical device with multiple functions connected to the LAN 32. The shift target position sensor 96 of shift mechanism 98 containing CPU 100, the throttle target opening sensor 102 of throttle mechanism 104 containing CPU 106, and the steering target angle sensor 108 of steering mechanism 110, are located individually in units 98, 104, and 110 respectively, and each function has a network address in the data set 90.

Figure 5:
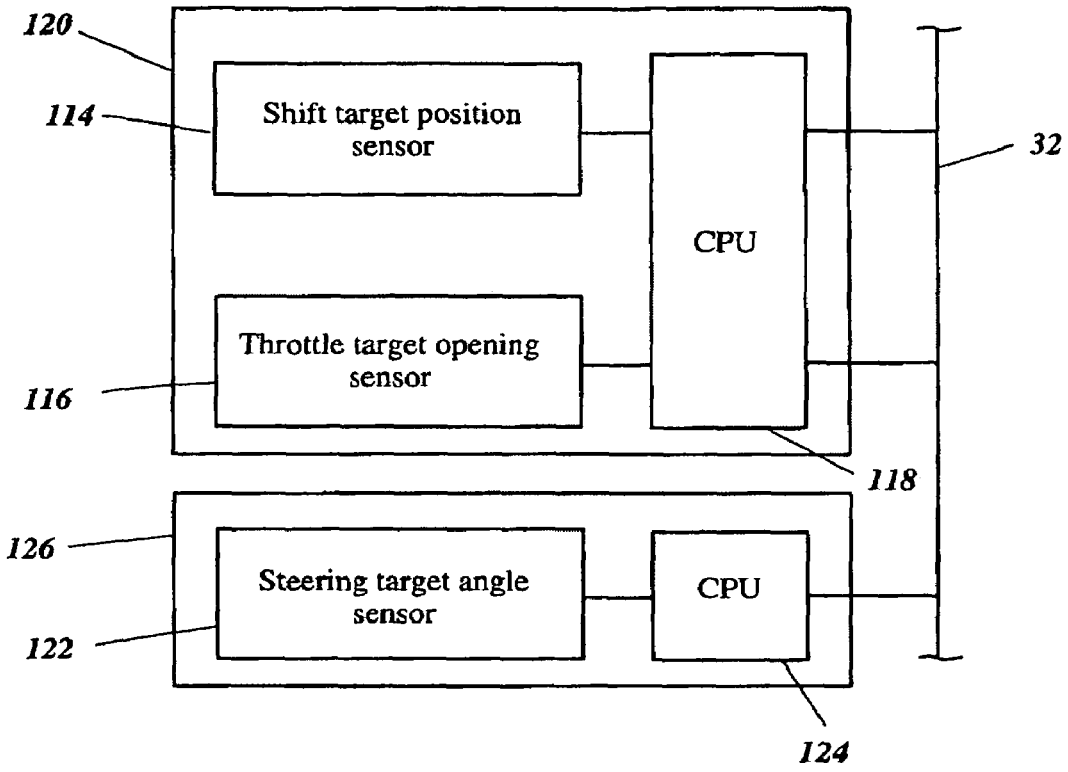
FIG. 5 is a schematic diagram illustrating a modification of the remote control device arrangement of FIG. 4.

FIG. 5 illustrates a modification of the remote control device arrangement shown in FIG. 4. In this modification, the shift target position sensor 114 and the throttle target opening sensor 116 are grouped together in a single device 120 and share a CPU 118 for communication over the LAN 32. The steering target angle sensor 122 of device 126 contains a CPU 124 for communication over the LAN 32. The modification in this configuration does not require the network to be reconfigured because each function has its own network address in the correlation module. In other words, because the correlation module correlates functions with network addresses, the devices on the network do not need to be re-programmed to recognize data from the sensors 114, 116, 122 because they have the same address used in the arrangement illustrated in FIG. 4.

Figure 6:
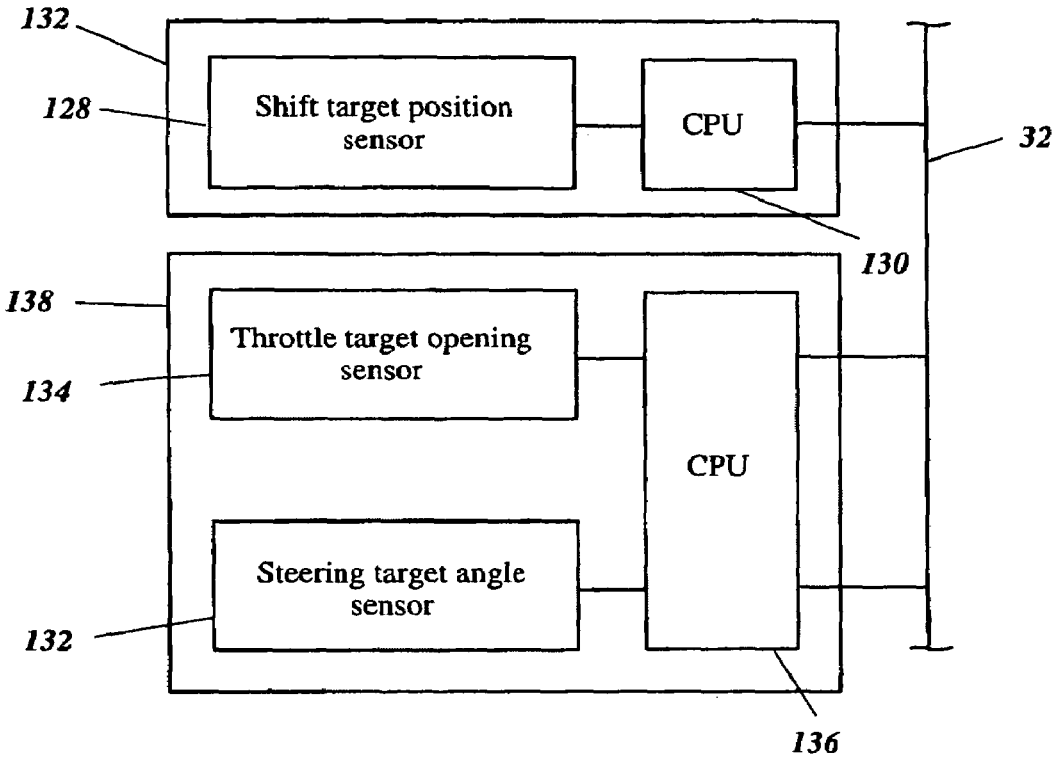
FIG. 6 is a schematic diagram illustrating a further modification of the remote control device arrangement of FIG. 4.

FIG. 6 illustrates another modification of the arrangement illustrated in FIG. 4. In this modification, the shift target position sensor 128 is disposed in a device 132 having a CPU 130. However, the throttle target opening sensor 134 is and the steering target angle sensor 132 are disposed in a device 138. These sensors share a CPU 136 for communication over the LAN 32. Similarly to that noted above with reference to FIGS. 4 and 5, this modification does not require the devices to be reprogrammed because each sensor retains the same network address, i.e., the addresses assigned to the throttle target, shift target, and steering target functional nodes in the data set 89.

Figure 7:
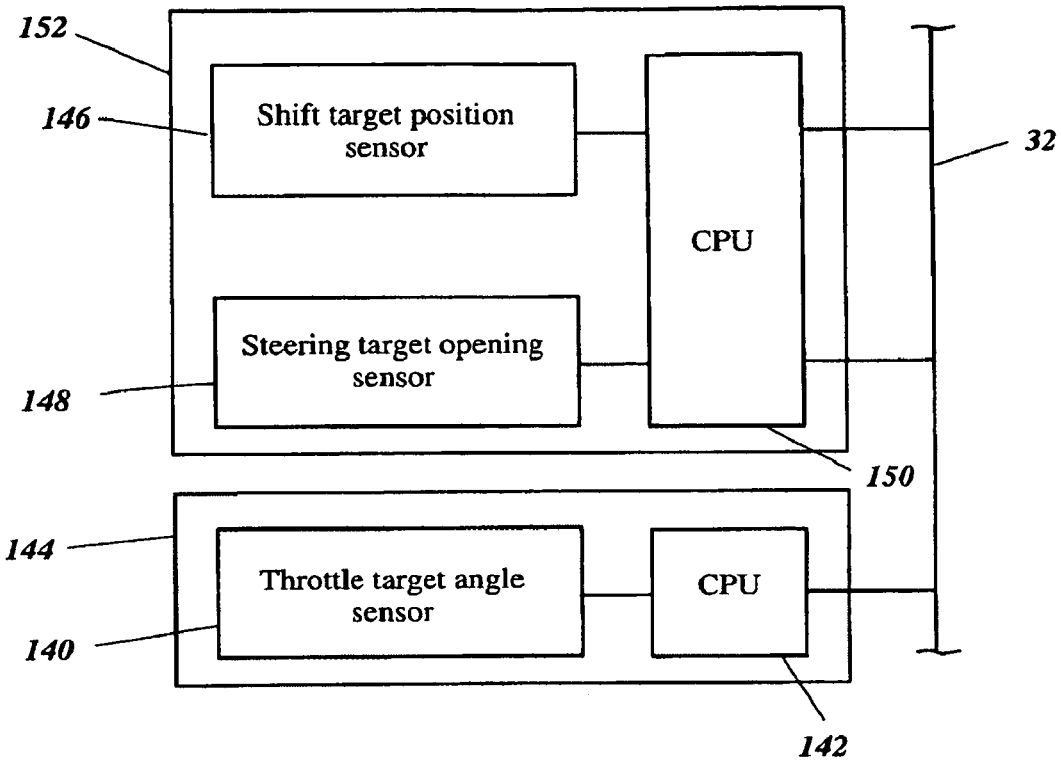
FIG. 7 is a schematic diagram illustrating another modification of the remote control device arrangement of FIG. 4.

FIG. 7 illustrates yet another modification of the arrangement illustrated in FIG. 4. In this modification, a throttle target position sensor 140 is disposed in a device 144, which includes a CPU 142 for communication over the LAN 32. The shift target opening sensor 146 and the steering target angle sensor 148 are disposed in a device 152, which includes a CPU 150 for communication over the LAN 32. As noted above with reference to FIGS. 4–6, the devices on the LAN 32 do not have to be reprogrammed because each sensor retains the same network address.

Figure 8:
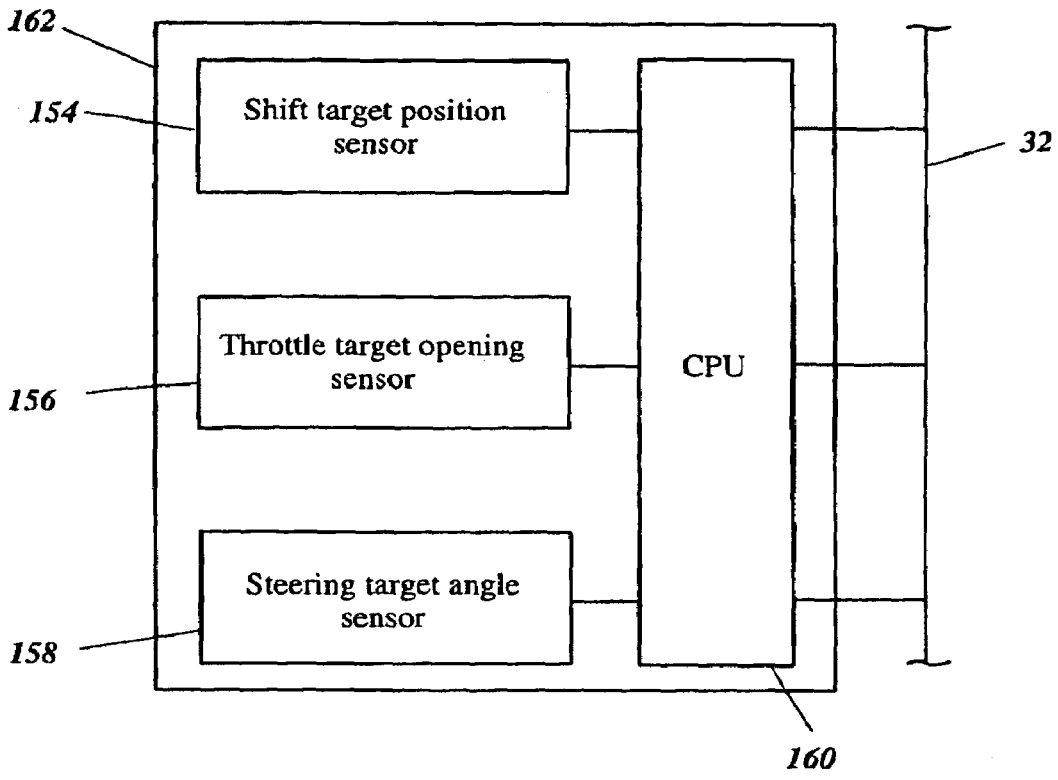
FIG. 8 is a schematic diagram illustrating an additional modification of the remote control device arrangement of FIG. 4.

FIG. 8 illustrates another modification of the arrangement illustrated in FIG. 4. In this modification, a shift target position sensor 154, a throttle target opening sensor 156, and a steering target angle sensor 158 are disposed in a device 162. The device 162 includes a CPU 160 which is configured to allow the sensors 154, 156, 158 to transmit signals over the LAN 32. As noted above with reference to FIGS. 4–7, the devices on the LAN 32 do not have to be reprogrammed because each sensor retains the same network address.

The modifications above are all achieved with out reconfiguring the correlation module 70 or the other devices on the LAN 32 because the functions are correlated to network addresses rather than to physical network addresses. By assigning a network address based on function the correlation module 70 remains constant and is not dependent on the devices attached to the network.

Optionally, functional nodes are given a priority order relating to the importance of the functions. For example, the stop engine function preferably is given priority over the engine speed sensing function. Thus, if data collides on the network, an engine stop command will be given priority on the LAN 32 because it has a higher priority designation in the correlation module. Only after the higher priority function is executed will the lower priority function be received.

Preferably the highest priority functions are given the lowest functional address assignments in the correlation module. Preferably a simple computer program can, in the case of a collision, forward the lower addressed function, and retain the higher addressed function until after the higher priority function command has been issued. However, it is to be noted that although the description set forth above is directed to an embodiment where priority is highest for lower numbered addresses, there are other ways to assign priority to functions and this should not be read as a limitation to the scope of this invention.

Figure 9:
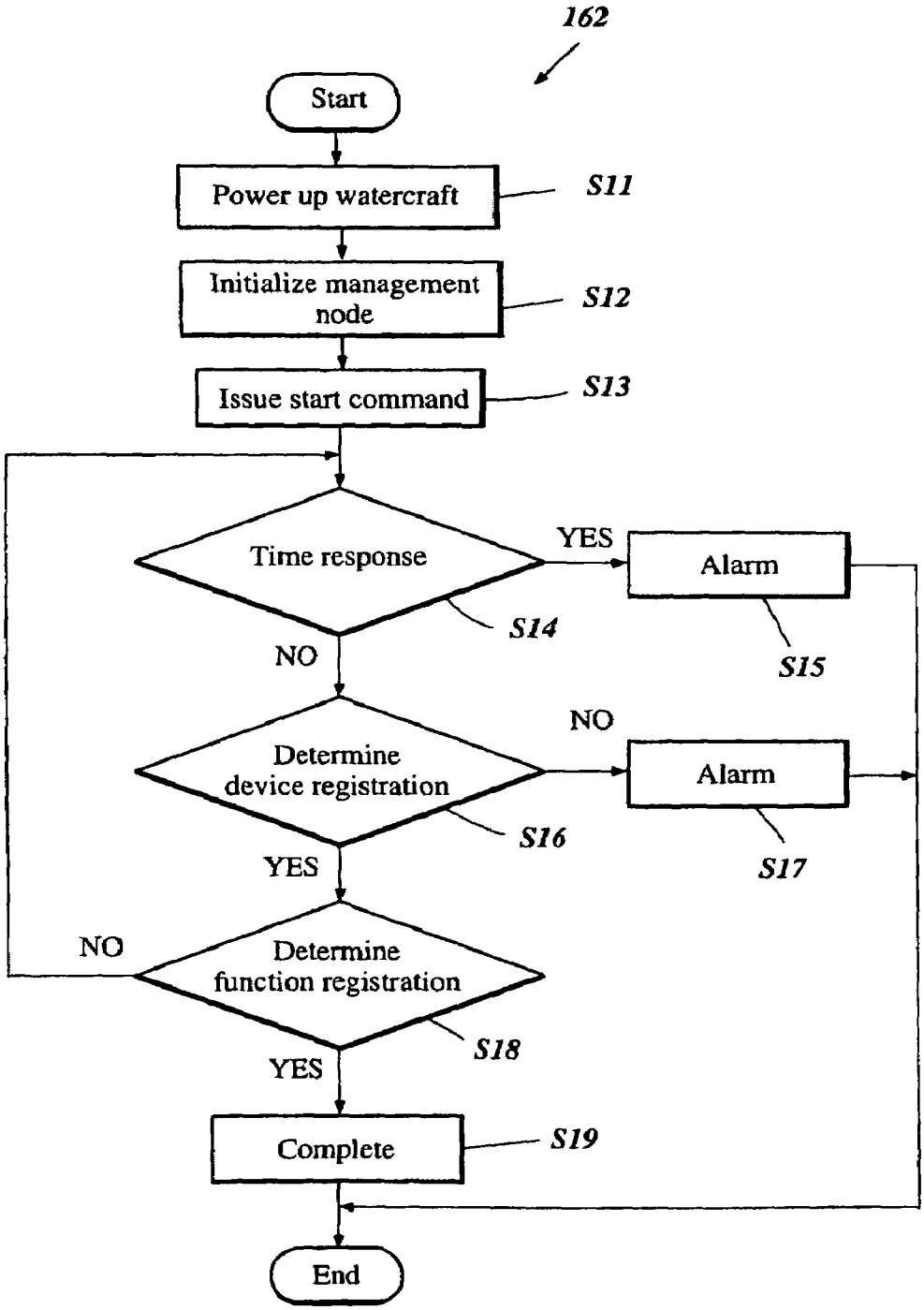
FIG. 9 is a flow diagram showing one example of a method for configuring a network in a watercraft upon start up.

FIG. 9 is a flow chart which illustrates a control routine 162 that can be used in connection with the LAN 32. The routine 162 begins when the main power switch of the watercraft 10 is activated, at step S11. Preferably this can be a key switch, such as they key switch 82, into which the operator inserts a key and turns to a startup position. After the step S11, the routine moves to a step S12.

In the step S12, the management node is initialized. Additionally, the correlation module is read into the memory of the management node. After the step S12, the routine 162 moves to step S13.

In the step S13, the management node issues a "start command" to the other physical device nodes on the network. The start command is a two part command. Part one is to start operation of the device, and part two is a command configured to cause of the device to send a replay signal with data indicating the functions which the device performs. After the step S13, the routine 162 moves on to a step S14.

In the step S14, a timer is started to clock a predetermined period of time during which the devices respond. This keeps the system from waiting indefinitely for a reply from a disconnected device. If the predetermined period of time has not elapsed, the routine 162 moves to a step S16.

In the step S16, it is determined whether the device identification returned in the reply signal is registered in the correlation module. For example, the management node can be used to determine if the device identification returned in the reply signal is registered in the correlation module 70. If the device identification returned in the reply signal is registered in the correlation module, the routine 162 moves to a step S18.

In the step S18, it is determined whether all of the devices on the LAN 32 have responded. If all the devices have responded, the routine 162 moves to a step S19 in which it is determined that the correlation of functions and network addresses is complete. Following the step S19, the routine 162 ends.

With reference to the step S14, if it is determined that the predetermined time has elapsed, the routine 162 moves to a step S15. In the step S115, an alarm is triggered. The alarm can be visual or audible, coming from either a visual device or a audio device, respectively. The alarm is triggered because if the routine 162 reaches the step S15, then all of the devices have not been registered.

With reference to the step S16, if it is determined that the reply signal is not registered in the correlation module, the routine 162 moves to step S117. In the step S17 an alarm, such as the alarm described above with reference to step S15, is triggered. The alarm is triggered in the step S17 because the negative determination in the step S16 indicates that an incorrect device or an incorrectly connected device is connected to the LAN 32. After the steps S15 and S17, the routine 162 ends.

With reference to the step S18, if the determination is "no", steps S14 through S18 are repeated until all devices have responded, or until the predetermined amount of time has elapsed. If the time has elapsed the determination is changed to no in the S14 and the fault alarm S15 is issued.

The embodiments of the present invention are not limited to those embodiments described above and various changes and modifications may be made without departing from the spirit and scope of the present invention.

What is claimed is:

1. A method for operating a network on a vehicle comprising:

activating electrical power for the network and all devices connected to the network;

transmitting a function identification command from a management node on the network to all the devices connected to the network;

clocking a time required for all of the devices to respond to be function identification command;

comparing the time required for all of the devices to respond with a predetermined time period;

transmit function identification replies from all of the devices connected to the network, wherein the replies indicate the functions performed by the devices, respectively;

comparing the functions with functions contained in a predetermined correlation of functions and network addresses on the network;

triggering an alarm if the devices do not respond within the predetermined time period; and triggering an alarm if the reply contains a function that is not correlated with a network address.

2. A method for operating a network on a vehicle comprising:

transmitting an identification command to all devices connected to the network;

transmitting replies from the devices in response to the identification command, the replies indicating the functions performed by the devices, respectively; and correlating the functions with network addresses.

3. The method of claim 2 additionally comprising assigning only one address to only one throttle actuator device.

4. The method of claim 2 additionally comprising assigning only one address to only one throttle lever position sensor.

* * * * *

UNITED STATES PATENT AND TRADEMARK OFFICE

CERTIFICATE OF CORRECTION

PATENT NO. : 7,184,867 B2
APPLICATION NO. : 11/508363
DATED : February 27, 2007
INVENTOR(S) : T. Okuyama It is certified that error appears in the above-identified patent and that said Letters Patent is hereby corrected as shown below:

In column 9, line 54, please delete "S115," and insert -- S15 --.

In column 10, line 3, please delete "S117," and insert -- S17 --.

Signed and Sealed this

Twenty-fourth Day of February, 2009

JOHN DOLL
*Acting Director of the United States Patent and Trademark Office*